US007759595B2

(12) United States Patent
Yoshitake et al.

(10) Patent No.: US 7,759,595 B2
(45) Date of Patent: Jul. 20, 2010

(54) GAS INSULATING SWITCHGEAR EQUIPPED WITH GROUNDING SWITCHGEAR

(75) Inventors: Yoichiro Yoshitake, Kitakyushu (JP); Dai Harada, Kitakyushu (JP)

(73) Assignee: Kabushiki Kaisha Yaskawa Denki, Fukuoka (JP)

( * ) Notice: Subject to any disclaimer, the term of this patent is extended or adjusted under 35 U.S.C. 154(b) by 431 days.

(21) Appl. No.: 11/722,198

(22) PCT Filed: Nov. 29, 2005

(86) PCT No.: PCT/JP2005/021870

§ 371 (c)(1),
(2), (4) Date: Jun. 20, 2007

(87) PCT Pub. No.: WO2006/067936

PCT Pub. Date: Jun. 29, 2006

(65) Prior Publication Data

US 2009/0250435 A1 Oct. 8, 2009

(30) Foreign Application Priority Data

Dec. 20, 2004 (JP) ..... 2004-367614

(51) Int. Cl.
*H01H 3/02* (2006.01)

(52) U.S. Cl. ..... 218/7; 218/84; 218/154

(58) Field of Classification Search ..... 218/7, 218/13, 14–20, 45, 55, 78, 84, 153, 154; 200/400, 401, 500, 501, 17 R
See application file for complete search history.

(56) References Cited

U.S. PATENT DOCUMENTS 4,513,208 A * 4/1985 Kamata ..... 218/84
5,604,340 A * 2/1997 Yamada et al. ..... 218/143
6,831,244 B2 * 12/2004 Kawamoto et al. ..... 218/78
2007/0068903 A1 * 3/2007 Hashimoto et al. ..... 218/57

FOREIGN PATENT DOCUMENTS

| | | | |
|---|---|---|---|
| EP | 1361633 | A2 * | 11/2003 |
| JP | 6-45232 | U | 6/1994 |
| JP | 7-85373 | B2 | 9/1995 |
| JP | 8-007717 | A | 1/1996 |
| JP | 11-329167 | A | 11/1999 |
| JP | 2002-051416 | A | 2/2002 |
| WO | 02/067394 | A2 | 8/2002 |

OTHER PUBLICATIONS

Fifty second volume, Yskawa Technical Review, Jul. 10, 1988, 91, Fig 9.

* cited by examiner

*Primary Examiner*—Renee Luebke
*Assistant Examiner*—Marina Fishman
(74) *Attorney, Agent, or Firm*—Sughrue Mion, PLLC

(57) ABSTRACT

A gas insulating switchgear equipped with a grounding switchgear of the invention includes a sealing vessel that fills an insulation gas, a main circuit-switching fixed electrode that is fixed to the sealing vessel, a movable electrode that comes in contact with the main circuit-switching fixed electrode, a grounding-switching fixed electrode capable of conducting current, and a driving device that drives the movable electrode, thereby driving the movable electrode. The main circuit-switching fixed electrode and the grounding-switching fixed electrode are linearly arranged in a longitudinal direction of the movable electrode, and the driving device drives linearly the movable electrode to three positions of a closed-circuit position, an open-circuit position, and a grounding position, and holds the movable electrode.

1 Claim, 6 Drawing Sheets

GAS INSULATING SWITCHGEAR EQUIPPED WITH GROUNDING SWITCHGEAR

TECHNICAL FIELD

The present invention relates to a gas insulating switchgear, and more specifically, to a gas insulating switchgear having a grounding switchgear.

BACKGROUND ART

There is a structural one shown in FIG. 6 as a switchgear of the related art (For instance, see Non-Patent Document).

FIG. 6 is a front view of gas insulating switchgear equipped with grounding switchgear of the related art. In FIG. 6, reference numeral 18 denotes a main circuit-switching movable electrode. The main circuit-switching movable electrode 18 is inserted into a main circuit-switching fixed electrode 3 by rotating an insulated lever 19, thereby the circuit is closed. Reference numeral 20 denotes a grounding-switching movable electrode, and the grounding-switching movable electrode 20 is engaged with a grounding-switching fixed electrode 21, which is mounted to the main circuit-switching fixed electrode 3, by rotating around a rotating shaft 20*a* of the grounding-switching movable electrode.

Thus, the gas insulating switchgear equipped with the grounding switchgear of the related art has separately a switch mechanism for the main circuit and a switch mechanism for switching the grounding.

In addition, as another example in the related art, there is a grounding device of a switchgear including a second lock member that allows only any one of a close-open operation from an open position to the other fixed electrode or a grounding operation from the open position to a movable electrode for the grounding provided in a movable body from operation and locks other operation in an output side of an actuation mechanism (for example, see Patent Document).

Non-Patent Document: "Fifty second volume published by Yaskawa Technical Review" on Jul. 10, 1988, FIG. 9 in p. 91

Patent Document: Examined Japanese Patent Application Publication No. Hei7-85373

DISCLOSURE OF THE INVENTION

Problems to be Solved by the Invention

However, since the gas insulating switchgear equipped with the grounding switchgear of the related art had two switch mechanisms in which a contact part for switching the main circuit and a contact part for switching the grounding are different to each other, there is a problem that the space for installing the mechanisms became larger. Moreover, there is a problem that the switch mechanism for switching the grounding became further larger when the inputting performance of the accident current is required for the grounding switchgear and it is necessary to rapidly operate the grounding-switching movable electrode.

The invention is made to solve the above problems and an advantage to provide a gas insulating switchgear equipped with grounding switchgear that can facilitate compactness by forming integrally the switch mechanism for switching the main circuit and the switch mechanism for switching the grounding and can rapidly operate even the grounding-switching movable electrode through the switch mechanisms.

Means for Solving the Problems

According to a first aspect of the invention, there is provided a gas insulating switchgear equipped with a grounding switchgear, the gas insulating switchgear including:

a sealing vessel that fills an insulation gas;

a main circuit-switching fixed electrode that is fixed to the sealing vessel;

a movable electrode that comes in contact with the main circuit-switching fixed electrode;

a grounding-switching fixed electrode capable of conducting current; and a driving device that drives the movable electrode, the main circuit being switched by the driving of the movable electrode, wherein the main circuit-switching fixed electrode and the grounding-switching fixed electrode are linearly arranged in a longitudinal direction of the movable electrode, and the driving device drives linearly the movable electrode to three positions of a closed-circuit position, an open-circuit position, and a grounding position and holds the movable electrode there.

In addition, according to a second aspect of the invention, there is provided the gas insulating switchgear equipped with a grounding switchgear, wherein the driving device includes:

an insulated link that drives the movable electrode;

a driving shaft that turns the insulated link;

a positioning cam that is fixed to the driving shaft to determine the three positions;

a driving lever that is fixed to an operating shaft;

an overshoot preventing claw that is engaged with the driving lever;

a driving cam that is engaged with the driving lever by a toggle spring; and a roller that is provide in a hub fixed to the driving shaft so as to be driven by the driving cam.

Effects of the Invention

According to the first and second aspects of the invention, the invention can facilitate compactness by forming integrally the switch mechanism for switching the main circuit and the switch mechanism for switching the grounding.

DESCRIPTION OF REFERENCE NUMERALS AND SIGNS

Figure 1:
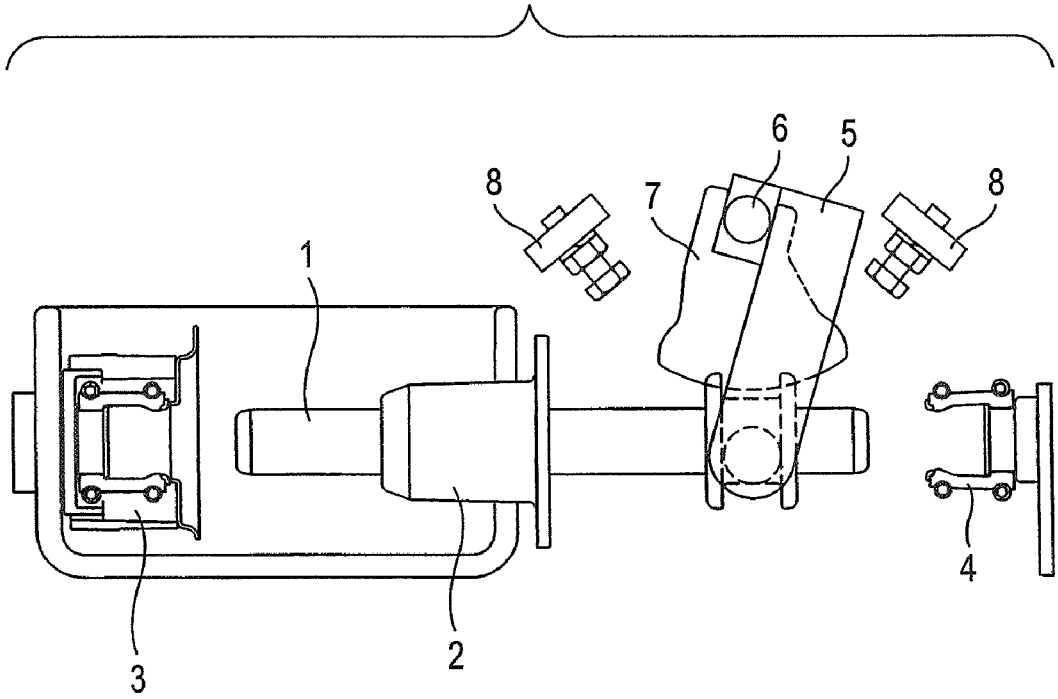
FIG. 1 is a sectional side view illustrating a main circuit of a gas insulating switchgear equipped with a grounding switchgear according to the invention.

1 movable electrode
2 current-conducting block
3 main circuit-switching fixed electrode
4 grounding-switching fixed electrode
5 insulated link
6 driving shaft
7 positioning cam
8, 81 stopper
9 hub
91 pin
92 roller
10 driving cam
11 driving lever
12 operating shaft
13 toggle spring
14 overshoot preventing claw
15 engaging pin
16 operating mechanism base
17 claw rotating shaft
18 main circuit-switching movable electrode
19 insulated lever
20 grounding-switching movable electrode
20*a* movable electrode rotating shaft for switching grounding
21 grounding-switching fixed electrode

BEST MODE FOR CARRYING OUT THE INVENTION

Hereinafter, embodiments of the invention will be described with reference to the accompanying drawings.

Figure 2:
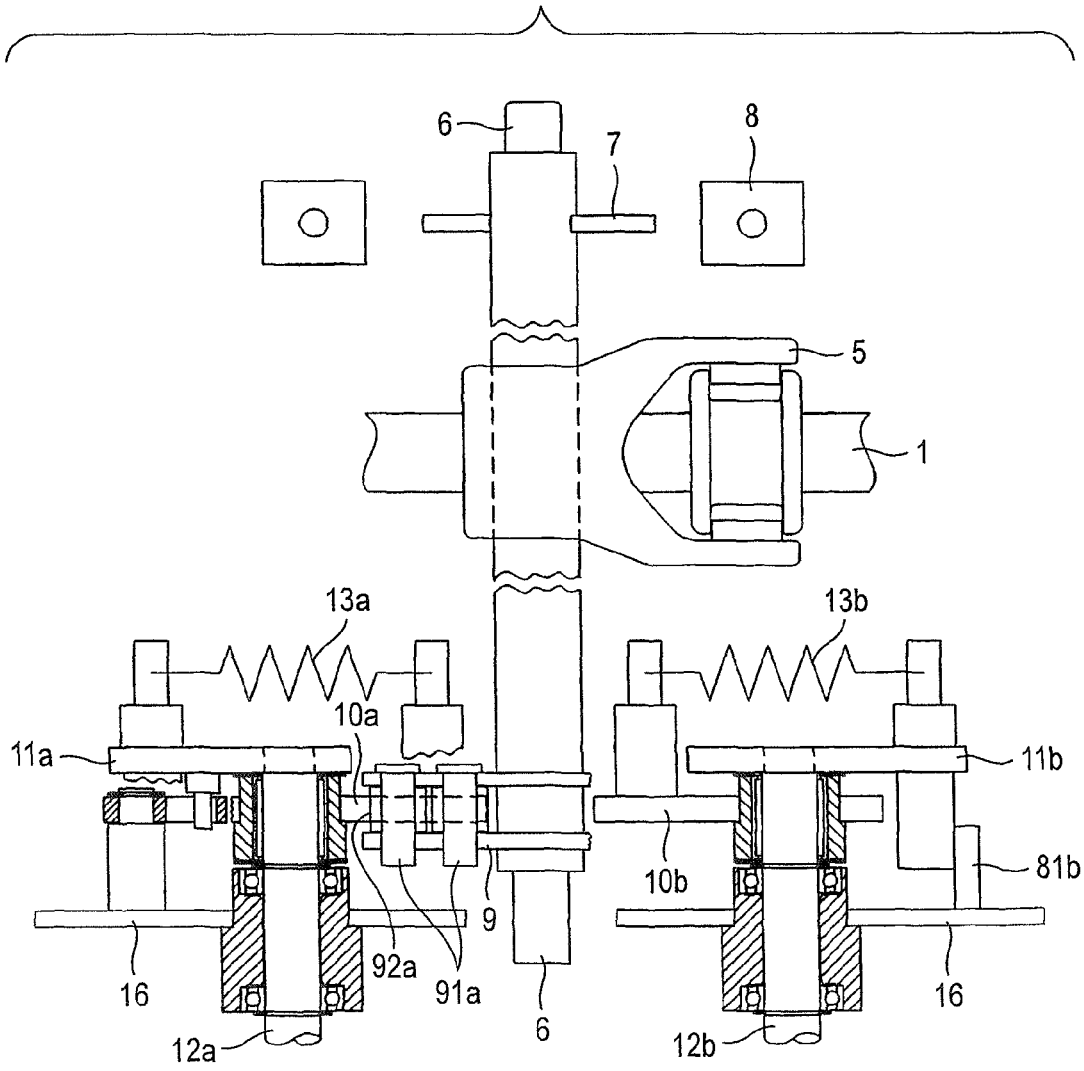
FIG. 2 is a top view of FIG. 1.

FIG. 1 is a sectional side view illustrating a main circuit of a gas insulating switchgear equipped with a grounding switchgear according to the invention, and FIG. 2 is a top view of FIG. 1. FIGS. 1 and 2 show an open circuit state in which both the main circuit and the grounding switchgear are opened. In FIGS. 1 and 2, reference numeral 1 denotes a movable electrode, numeral 2 denotes a current-conducting block, numeral 3 denotes a main circuit-switching fixed electrode (with an arc extinguishing device), numeral 4 denotes a grounding-switching fixed electrode (with an arc resistant device), numeral 5 denotes an insulated link, and numeral 6 denotes a driving shaft. The movable electrode 1 is fixed to both ends by welding with pressure or brazing an arc resistant metal to move on a straight line. The current-conducting block 2 performs the movement support and the current-conducting of the movable electrode 1 at the same time. The main circuit-switching fixed electrode 3 is provided with the arc extinguishing device and performs a load current input, interception, current-conducting, accident current input, and accident current-conducting of the gas insulating switchgear. The grounding-switching fixed electrode 4 is a fixed electrode in which the arc resistant metal is brazed to a tip thereof and performs the accident current input and accident current-conducting of the grounding switchgear of the gas insulating switchgear. The insulated link 5 drives the movable electrode 1 in a straight, that is, drives the movable electrode to a closed circuit position of the main circuit-switching fixed electrode 3 or a grounding position of the grounding-switching fixed electrode 4. The insulated link 5 is attached to the driving shaft 6, and the driving shaft 6 is supported so as to be freely rotated. Reference numeral 7 denotes a positioning cam for determining the position of the movable electrode 1, and numerals 8 and 81 denote stoppers. Reference numeral 9 denotes a hub that is fixed to the driving shaft. Reference numeral 91 denotes a pin that is fixed to the hub 9, and numeral 92 denotes a roller that is rotatably mounted to the pin 91, and two rollers are provided at right and left sides, respectively. Reference numeral 10 denotes a driving cam, numeral 11 denotes a driving lever, numeral 12 denotes an operating shaft for actuating the operating mechanism, and numeral 13 denotes a toggle spring. These are provided at the right and left sides one by one, respectively.

Figure 3:
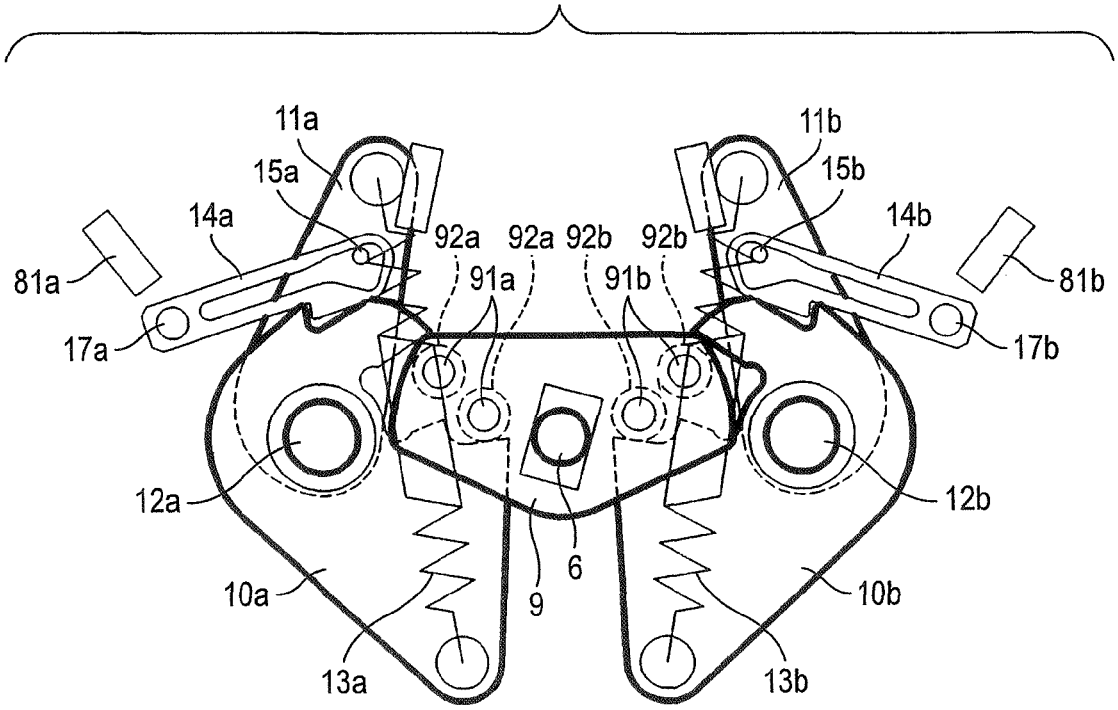
FIG. 3 is a partially enlarged view illustrating in detail an operating mechanism of FIG. 1 (open-circuit state).

FIG. 3 is a partially enlarged view illustrating of an operating mechanism for driving the insulated link 5. FIG. 3 shows an open circuit state in which both the main circuit and the grounding switchgear are opened.

In FIG. 3, reference numeral 14 denotes an overshoot preventing claw, numeral 15 denotes an engaging pin, numeral 16 denotes an operating mechanism base, and numeral 17 denotes a claw rotating shaft. These are provided at the right and left sides one by one except for the operating mechanism base 16.

The driving cam 10 rotates around the operating shaft 12 to rotate the driving shaft 6 by pressing the roller 92 fixed to the driving shaft 6 with a cam part oneself. The driving lever 11 rotates around the operating shaft 12 to rotate the driving cam 10 by discharging energy after storing energy of the toggle spring 13. The overshoot preventing claw 14 prevents the overshoot when the driving shaft 6 is driven from the closed circuit position to the open circuit position or from the grounding position to the open circuit position. The engaging pin 15 is a pin for engaging with the overshoot preventing claw 14 disposed in the driving lever 11. The operating mechanism base 16 supports components of the operating mechanism. The claw rotating shaft 17 supports rotatably the overshoot preventing claw 14.

The invention differs from Non-Patent Document in that the driving device is located midway in the movable electrode 1, the main circuit-switching fixed electrode 3 and the grounding-switching fixed electrode 4 are disposed at the right and left sides or at the upper and lower sides of the movable electrode 1 in a straight, and the movable electrode 1 can be driven by one driving device.

An operation for closing the main circuit will be described now.

Figure 4:
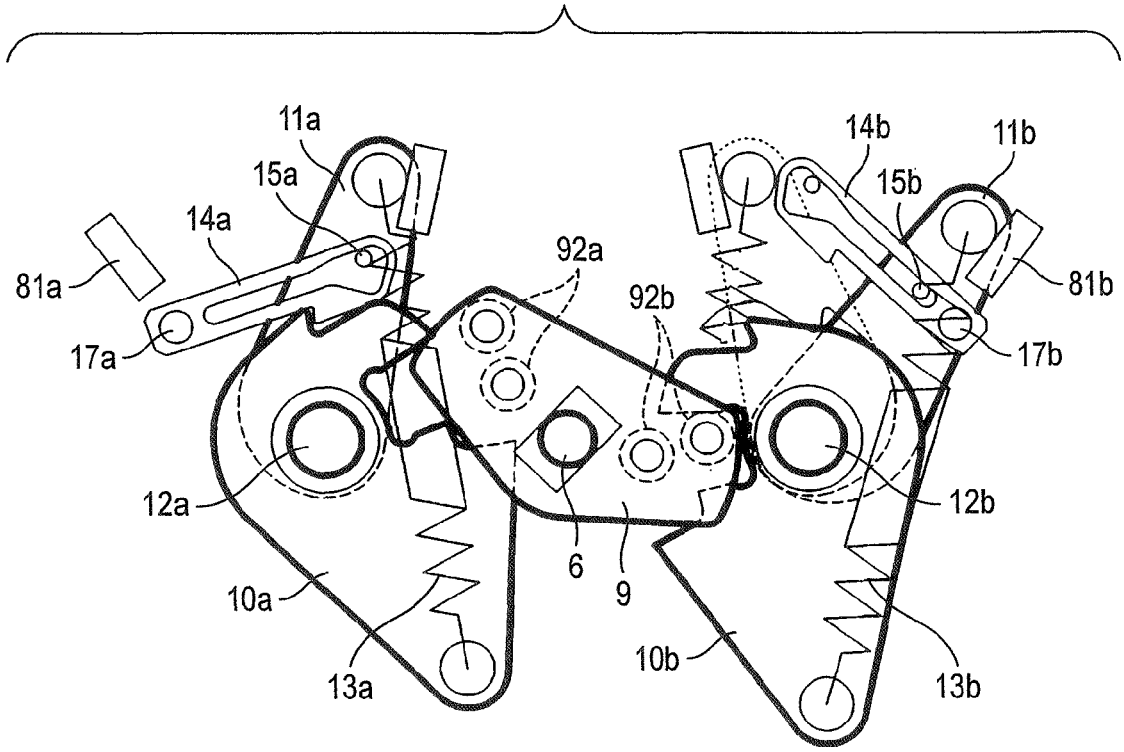
FIG. 4 is a partially enlarged view illustrating in detail an operating mechanism of FIG. 1 (closed-circuit state).

FIG. 4 is a sectional view illustrating an operating mechanism illustrating the closed-circuit operation of FIG. 1. FIG. 4 shows the closed circuit state in which the main circuit is closed and the grounding switchgear is opened.

(1) An operating shaft 12*b* is rotated clockwise from the open circuit state of FIG. 3.

(2) A driving lever 11*b* is rotated clockwise, and the energy of a toggle spring 13*b* is stored at the same time.

(3) When the toggle spring 13*b* exceeds a dead point, the energy of the toggle spring 13*b* is discharged, and a driving cam 10*b* is rotated anticlockwise.

(4) The driving cam 10*b* presses a roller 92*b* fixed to the hub 9, and the driving shaft 6 connected to the hub 9 is rotated clockwise.

(5) At the same time, the insulated link 5 (FIG. 1) fixed to the driving shaft 6 is rotated clockwise, and the movable electrode 1 is linearly driven toward the closed position in the direction of the fixed electrode 3, thereby the main circuit is closed.

(6) The movable electrode 1 driven to the closed-circuit position is positioned at a predetermined closed-circuit position by the positioning cam 7 and the stopper 8 (FIG. 1), thereby completing the closed-circuit operation.

Next, an operation for opening the main circuit will be described.

(1) The operating shaft 12*b* is rotated anticlockwise from the state of FIG. 4.

(2) The driving lever 11*b* is rotated anticlockwise, and the energy of a toggle spring 13*b* is stored at the same time.

(3) When the toggle spring 13*b* exceeds a dead point, the energy of the toggle spring 13*b* is discharged, and the driving cam 10*b* is rotated clockwise.

(4) The driving cam 10*b* presses the roller 92*b* fixed to the driving shaft 6 to rotate the driving shaft 6 anticlockwise.

(5) At the same time, the insulated link 5 (FIG. 1) fixed to the driving shaft 6 is rotated anticlockwise, and the movable electrode 1 is linearly driven from the closed-circuit position to the open circuit position, thereby the main circuit is opened.

(6) The movable electrode 1 driven to the open-circuit position overshoots in the direction of the fixed electrode 4 for the grounding switchgear by inertial force during driving. The force rotates the driving cam 11*a* clockwise by the roller 92*a* through the insulated link 5 (FIG. 1) and the driving shaft 6, but if the driving cam 10*a* is caught in the overshoot preventing claw 14*a*, it does not rotate any more. For this reason, the overshoot of the movable electrode 1 is restrained to the minimum.

The overshoot preventing claw 14*a* serving as a rotation prevention of the driving cam 10*a* as described above, that is, serving as an overshoot prevention of the movable electrode 1 is engaged with a driving lever 11*a* by an engaging pin 15*a* protruded from the driving lever 11*a*. For this reason, during the grounding operation of the grounding switchgear described below, if the driving lever 11*a* is rotated anticlockwise, the overshoot preventing claw 14*a* rotates around a claw rotating shaft 17*a* attached to the operating mechanism base 16 (FIG. 2), thereby the engagement of the overshoot preventing claw 14*a* and the driving cam 10*a* comes loose. Accordingly, the clockwise rotation of the driving cam 10*a*, that is, the grounding operation is not obstructed.

Next, an operation for closing the grounding switchgear will be described.

Figure 5:
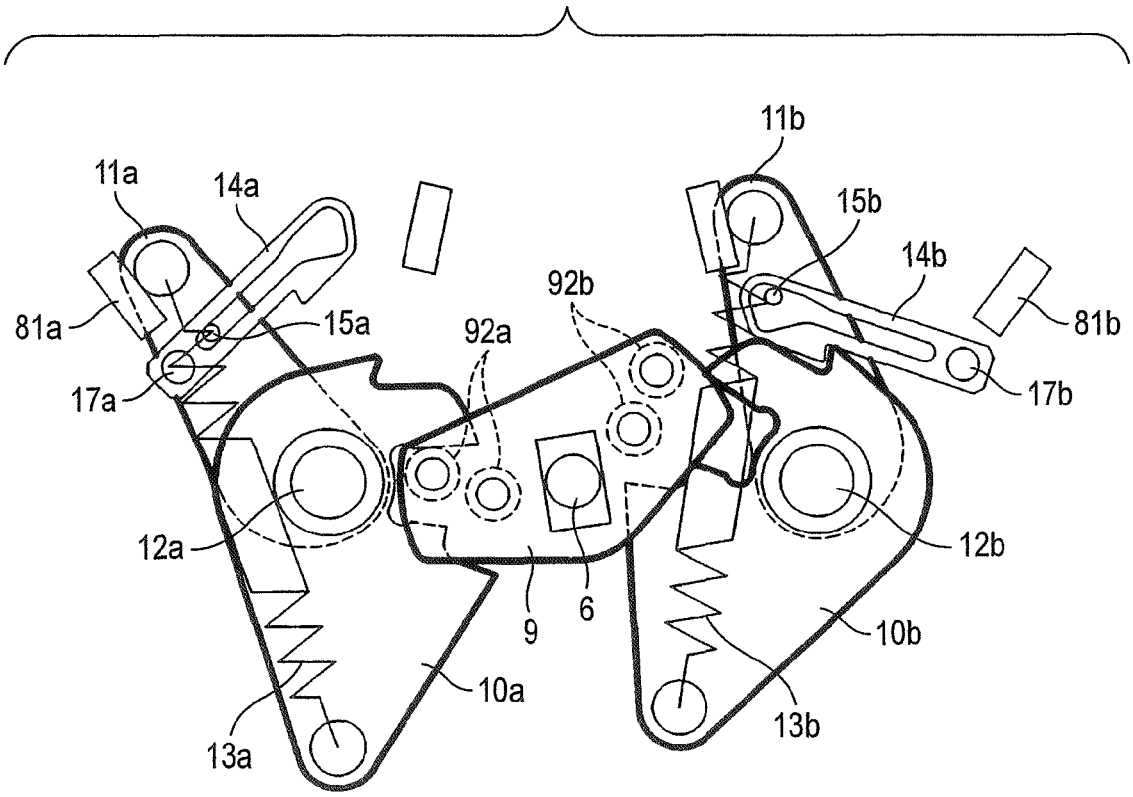
FIG. 5 is a partially enlarged view illustrating in detail an operating mechanism of FIG. 1 (grounding state).
Figure 6:
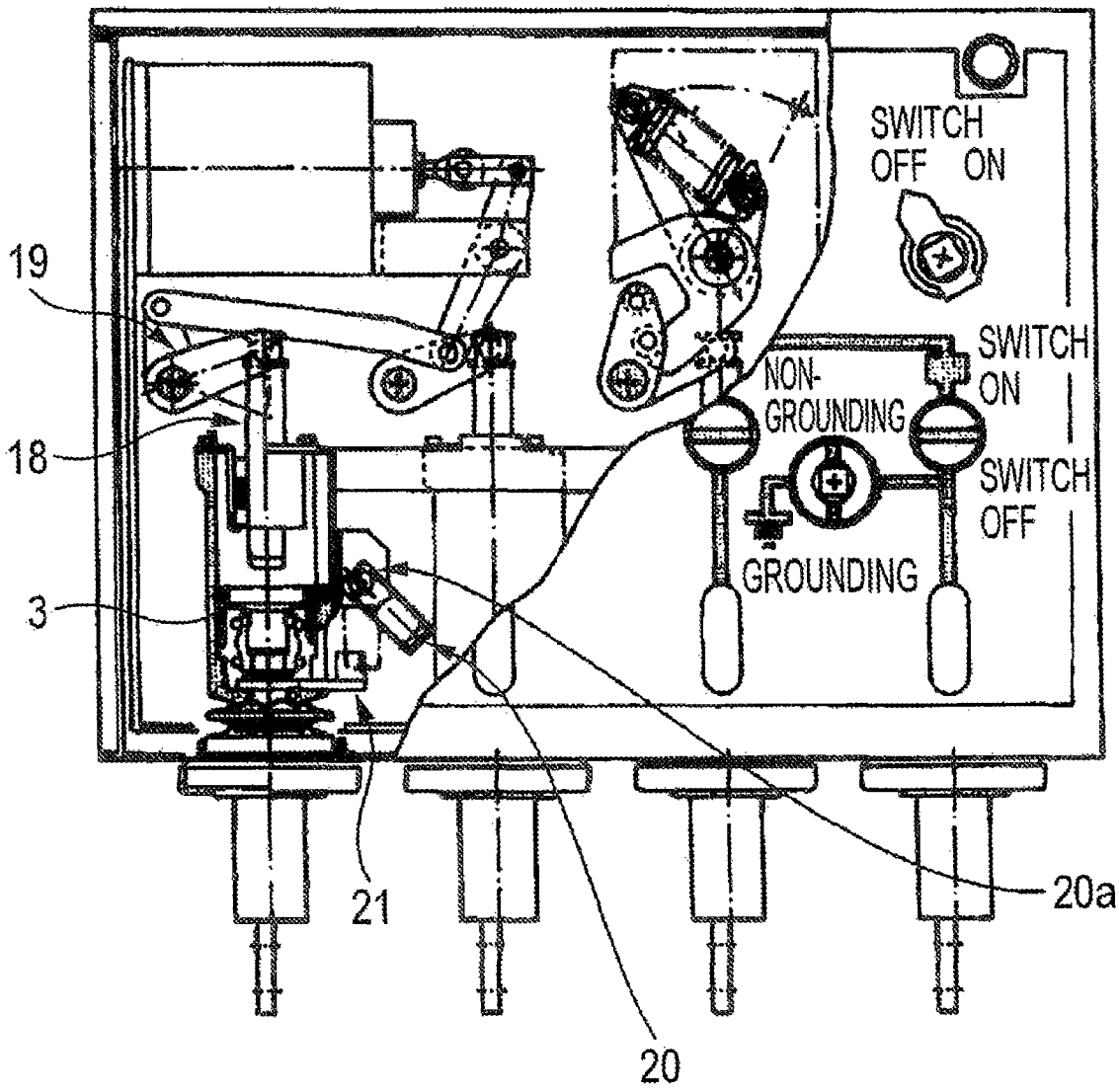
Prior Art FIG. 6
FIG. 6 is a front view illustrating schematically a gas insulating switchgear equipped with a grounding switchgear according to the related art.

FIG. 5 is a partially enlarged view illustrating in detail an operating mechanism. FIG. 5 shows the grounding state in which the main circuit is opened and the grounding switchgear is closed.

(1) An operating shaft 12*a* is rotated anticlockwise from the open circuit state of FIG. 3.

(2) A driving lever 11*a* is rotated anticlockwise, and the energy of a toggle spring 13*a* is stored at the same time.

(3) When the toggle spring 13*a* exceeds a dead points the energy of the toggle spring 13*a* is discharged to rotate a driving can 10*a* clockwise.

(4) The driving cam 10*a* presses a roller 92*a* fixed to the hub 9, and the driving shaft 6 connected to the hub 9 is rotated anticlockwise.

(5) At the same time, the insulated link 5 (FIG. 1) fixed to the driving shaft 6 is rotated anticlockwise, and the movable electrode 1 is linearly driven toward the grounding position in the direction of the fixed electrode 4, thereby the grounding switchgear is closed.

(6) The movable electrode 1 driven to the grounding position is positioned at a predetermined grounding position by the positioning cam 7 and the stopper 8 (FIG. 1), thereby completing the grounding operation.

The invention claimed is:

1. A gas insulating switchgear equipped with a grounding switchgear, the gas insulating switchgear comprising:

a sealing vessel that fills an insulation gas;

a main circuit-switching fixed electrode that is fixed to the sealing vessel;

a movable electrode that comes in contact with the main circuit-switching fixed electrode;

a grounding-switching fixed electrode capable of conducting current; and a driving device that drives the movable electrode, the main circuit being switched by the driving of the movable electrode, wherein the main circuit-switching fixed electrode and the grounding-switching fixed electrode are linearly arranged in a longitudinal direction of the movable electrode, and the driving device drives linearly the movable electrode to three positions of a closed-circuit position, an open-circuit position, and a grounding position and holds the movable electrode there, wherein the driving device includes:

an insulated link that drives the movable electrode;

a driving shaft that turns the insulated link;

a positioning cam that is fixed to the driving shaft to determine the three positions;

a driving lever that is fixed to an operating shaft;

an overshoot preventing claw that is engaged with the driving lever;

a driving cam that is engaged with the driving lever by a toggle spring; and a roller that is provide in a hub fixed to the driving shaft so as to be driven by the driving cam.

* * * * *